US008444782B2

(12) United States Patent
Kim et al.

(10) Patent No.: US 8,444,782 B2
(45) Date of Patent: May 21, 2013

(54) MANUFACTURING METHOD OF HIGH STRENGTH FERRITIC/MARTENSITIC STEELS

(75) Inventors: Woo-Gon Kim, Daejeon (KR); Chan-Bock Lee, Daejeon (KR); Jong-Hyuk Baek, Daejeon (KR); Do-Hee Hahn, Seoul (KR); Sung-Ho Kim, Daejeon (KR); Chang-Hee Han, Daejeon (KR); Tae-Kyu Kim, Daejeon (KR); Jun-Hwan Kim, Daejeon (KR)

(73) Assignee: Korea Atomic Energy Research Institute, Daejeon (KR)

( * ) Notice: Subject to any disclaimer, the term of this patent is extended or adjusted under 35 U.S.C. 154(b) by 385 days.

(21) Appl. No.: 12/612,101

(22) Filed: Nov. 4, 2009

(65) Prior Publication Data

US 2010/0108207 A1 May 6, 2010

(30) Foreign Application Priority Data

Nov. 6, 2008 (KR) ..... 10-2008-0109870

(51) Int. Cl.
*C21D 8/00* (2006.01)

(52) U.S. Cl.
USPC ..... 148/651; 148/609

(58) Field of Classification Search ..... 148/651, 148/609, 610; *C21D 1/00, 1/28, 8/00*
See application file for complete search history.

(56) References Cited

U.S. PATENT DOCUMENTS 3,653,981 A * 4/1972 Watanabe et al. ..... 148/610

FOREIGN PATENT DOCUMENTS

EP 1544312 A1 * 6/2005

* cited by examiner

*Primary Examiner* — Keith Walker
*Assistant Examiner* — Alexander Polyansky
(74) *Attorney, Agent, or Firm* — Hammer & Associates, P.C.

(57) ABSTRACT

Provided is a method of manufacturing a high strength ferritic/martensitic steel. The method includes melting a ferritic/martensitic steel, hot-working the melted ferritic/martensitic steel, normalizing the hot-worked ferritic/martensitic steel at a temperature of about 1050° C. to about 1200° C., tempering the ferritic/martensitic steel at a temperature of about 600° C. or less, and leaving MX precipitates while preventing a $M_{23}C_6$ precipitate from being precipitated, and cold-working and thermal-treating the ferritic/martensitic steel in a multistage fashion, and precipitating $M_{23}C_6$ precipitates. Through the above described configuration, the high strength ferritic/martensitic steel that prevents a ductility from being deteriorated even in a high-temperature environment may be manufactured.

1 Claim, 2 Drawing Sheets

MANUFACTURING METHOD OF HIGH STRENGTH FERRITIC/MARTENSITIC STEELS

CROSS-REFERENCE TO RELATED APPLICATIONS

This application claims the benefit of Korean Patent Application No. 10-2008-0109870, filed on Nov. 6, 2008, in the Korean Intellectual Property Office, the disclosure of which is incorporated herein by reference.

BACKGROUND

1. Field

Exemplary embodiments relate to a method of manufacturing a ferritic/martensitic steel used in a nuclear power reactor, and more particularly, to a method of manufacturing a high strength ferritic/martensitic steel that may possess a high strength even in a high-temperature environment.

2. Description of the Related Art

General ferritic/martensitic steels containing 9 to 12 wt % of chrome may have high thermal conductivities, low expansion coefficients and excellent neutron irradiation resistances, and these steels may be used extensively as nuclear fuel cladding tube materials and structural materials in a fast reactor, a fusion reactor, and the like.

With respect to the manufacturing process of nuclear fuel cladding tubes of the high chrome ferritic/martensitic steel, a raw material may be melted by a vacuum induction melting process, a hot-working, a heat treatment, a cold-working, and a final heat treatment (normalizing and tempering) may be sequentially performed. Here, the hot-working may denote a hot-forging process and a hot-extrusion process, and the cold-working may denote a cold-pilgering process and a cold-drawing process. The normalizing and tempering of the final heat treatment may be respectively performed at a temperature of about 1050° C. to 1150° C. and a temperature of about 730° C. to 780° C., and a time required for the heat treatment may be determined by a thickness of the steel.

The high chrome ferritic/martensitic steel manufactured as described above may have limits to improving strength of the steel obtained by changing a temperature of the heat treatment after the hot-working or manufacturing variables such as in the cold-working, the final heat treatment, and the like. In particular, in a high-temperature environment of about 600° C. or more, a yield strength and a tensile strength may be deteriorated.

SUMMARY

An aspect of exemplary embodiments provides a method of manufacturing a high strength ferritic/martensitic steel that may have an improved high-temperature yield strength and tensile strength in a high temperature environment.

An aspect of exemplary embodiments also provides a method of manufacturing a high strength ferritic/martensitic steel that may have an excellent ductility while having an improved high-temperature yield strength and tensile strength.

According to an aspect of exemplary embodiments, there is provided a method of manufacturing a high strength ferritic/martensitic steel, the method including: melting a raw material of a ferritic/martensitic steel; hot-working the melted ferritic/martensitic steel; normalizing the hot-worked ferritic/martensitic steel at a temperature of about 1050° C. to about 1200° C.; tempering the normalized ferritic/martensitic steel;

and cold-working the tempered ferritic/martensitic steel in a multistage fashion, and thermal-treating the cold-worked ferritic/martensitic steel in a multistage fashion at a temperature of about 730° C. to 780° C. to correspond to the cold-working in the multistage fashion. Here, for convenience of the invention, the hot-working such as a hot-forging process and a hot-extrusion process may be replaced with a hot-rolling process, and the cold-working such as a cold-pilgering process or a cold-drawing process may be replaced with a cold-rolling process.

In this instance, the normalizing of the hot-worked ferritic/martensitic steel may include a thermal-treating of the hot-worked ferritic/martensitic steel at a temperature of about 1050° C. for one hour, and the tempering of the normalized ferritic/martensitic steel may include thermal-treating the normalized ferritic/martensitic steel at a temperature of about 600° C. or less, thereby leaving only MX precipitates while avoiding the formation of $M_{23}C_6$ precipitates.

Also, the thermal-treated ferritic/martensitic steel obtained by thermal-treating the normalized ferritic/martensitic steel may be cold-worked by about 95% by the cold-working and the thermal-treating performed in the multistage fashion. More specifically, the cold-working and the thermal-treating performed in the multistage fashion may include cold-rolling the tempered ferritic/martensitic steel in three stages by about 5% to about 95%, and may include thermal-treating the ferritic/martensitic steel at about 730° C. to about 780° C. for 1 to 30 minutes to thereby precipitate $M_{23}C_6$ precipitates when the cold-rolling for each stage is completed.

According to another aspect of exemplary embodiments, there is provided a method of manufacturing a high strength ferritic/martensitic steel, the method including: melting a raw material of a ferritic/martensitic steel; hot-working the melted ferritic/martensitic steel; normalizing the hot-worked ferritic/martensitic steel at a temperature of about 1050° C. to about 1200° C.; tempering the ferritic/martensitic steel, and leaving MX precipitates while avoiding the formation of $M_{23}C_6$ precipitates; and cold-working and thermal-treating the ferritic/martensitic steel in a multistage fashion, and precipitating $M_{23}C_6$ precipitates.

Here, the MX precipitates may remain after the normalizing of the hot-worked ferritic/martensitic steel or after the tempering of the ferritic/martensitic steel at a temperature of about 600° C. or less. It may be noted that the thermal treating may be performed while the cold-working is being performed after the tempering, or the thermal treating may be performed after the cold-working, thereby precipitating the $M_{23}C_6$ precipitates.

Also, the precipitating of the $M_{23}C_6$ precipitates may repeatedly perform the thermal-treating at a temperature of about 730° C. to about 780° C. at least three times after each cold-working stage of the ferritic/martensitic steel.

EFFECT

According to conventional art, normalizing and tempering may be performed on the ferritic/martensitic steel by means of a final thermal-treatment after hot-working and cold-working the ferritic/martensitic steel, and thus $M_{23}C_6$ precipitates may be mainly distributed in prior austenite grain boundaries. According to the present invention, the temperature of the tempering may be lowered to about 550° C. after the hot-working and the normalizing, thereby preventing the $M_{23}C_6$ precipitates from being precipitated, and having only the MX precipitates remain. Next, the cold-working and the thermal treating of subsequent processes may be performed in a multistage fashion, and thereby a dislocation generated during the cold-working may act as favorable nucleation sites for the $M_{23}C_6$ precipitates when precipitating the $M_{23}C_6$ precipitate at the time of the thermal treating performed in the multistage fashion. As a result, the $M_{23}C_6$ precipitate generated on the ferritic/martensitic steel may be very fine, and may be uniformly distributed. Therefore, a yield strength and a tensile strength in a high temperature environment of about 600° C. or more may be improved by about 30% or more, and at the same time a deterioration in a ductility may be prevented, thereby providing a high strength ferritic/martensitic steel adopted in a nuclear power reactor an extreme environment.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

Figure 1:
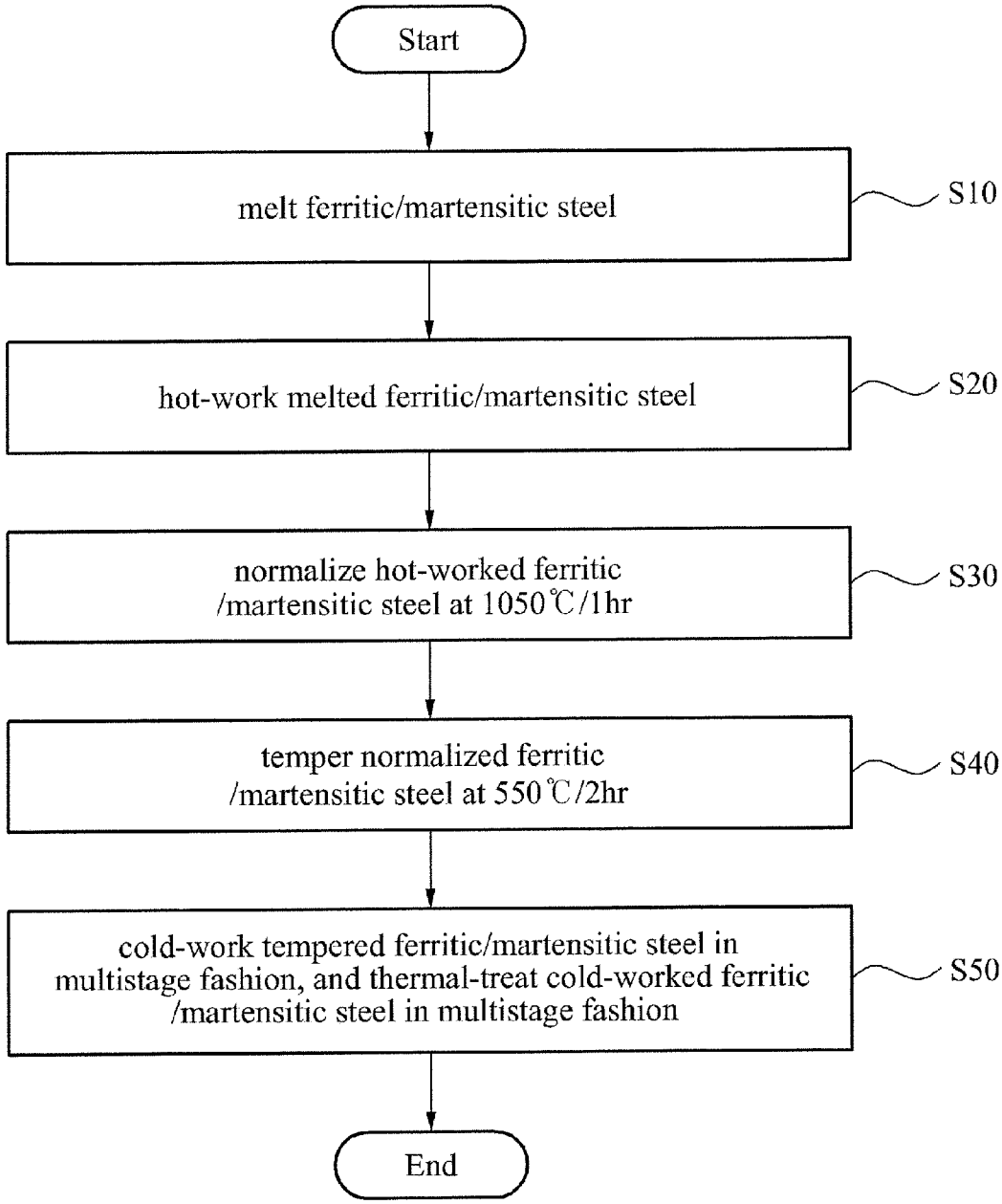
FIG. 1 is a flowchart illustrating a method of manufacturing a ferritic/martensitic steel according to exemplary embodiments of the present invention.

Reference will now be made in detail to exemplary embodiments, examples of which are illustrated in the accompanying drawings, wherein like reference numerals refer to the like elements throughout. Exemplary embodiments are described below to explain the present disclosure by referring to the figures.

FIG. 1 is a flowchart illustrating a method of manufacturing a ferritic/martensitic steel according to exemplary embodiments of the present invention.

Referring to FIG. 1, the method of manufacturing the ferritic/martensitic steel may include melting S10, hot-working S20, normalizing S30, tempering S40, and multi-stage cold-working and thermal-treating S50.

The melting S10 may be a process of melting a raw material of the ferritic/martensitic steel. The melting S10 may melt the raw material of the ferritic/martensitic steel by a vacuum induction melting process. Also, the melted ferritic/martensitic steel may be a high chrome ferritic/martensitic steel containing about 9 wt % to 12 wt % of chrome along with the minor elements such as W, Mo, Nb, V, Si, Mn, Ni, C and N.

The hot-working S20 may be a hot-forging process of the melted ferritic/martensitic steel at a high temperature, and a thermal-extrusion process of thermal-extruding the hot-forged ferritic/martensitic steel after processing the hot-forged ferritic/martensitic steel using a billet.

The normalizing S30 may be performed by heating the hot-worked ferritic/martensitic steel at a temperature of about 1000° C. or more. According to the present exemplary embodiment, in the normalizing S30, the ferritic/martensitic steel may be heated under a condition of 1050° C./1 hr.

Next, the normalized ferritic/martensitic steel may be tempered in the tempering S40. More specifically, in the tempering S40, the hot-worked and normalized ferritic/martensitic steel may be heated again to a temperature of about 600° C. or less, and then the heated ferritic/martensitic steel may be cooled in the air, thereby softening a structure to eliminate an internal stress. The ferritic/martensitic steel subjected to the tempering S40 may not be transformed or cracked according to characteristics of the tempering S40, when used. A temperature of the tempering of the ferritic/martensitic steel may be relatively lower in comparison with about 730° C. to about 780° C. of a conventional art, and thereby only MX precipitates may be remained from the ferritic/martensitic steel. That is, at the time of the tempering S40, $M_{23}C_6$ precipitates may not be precipitated from the ferritic/martensitic steel.

For reference, according to the present exemplary embodiment, in the tempering S40, the ferritic/martensitic steel may be heated at a temperature of about 550° C. for two hours.

In the multi-stage cold-working and thermal-treating S50, the tempered ferritic/martensitic steel may be cold-worked in a multistage fashion, and the cold-worked ferritic/martensitic steel may be thermal-treated in a multistage fashion at a temperature of about 730° C. to 780° C. to correspond to the multistage cold-working. Here, the cold-working may be a process in which a ferritic/martensitic steel tube may be pilgered or drawn in room temperature to be extended, thereby increasing a strength of the ferritic/martensitic steel. The multistage cold-working and the thermal-treating S50 will be herein described in detail with reference to FIG. 2.

Figure 2:
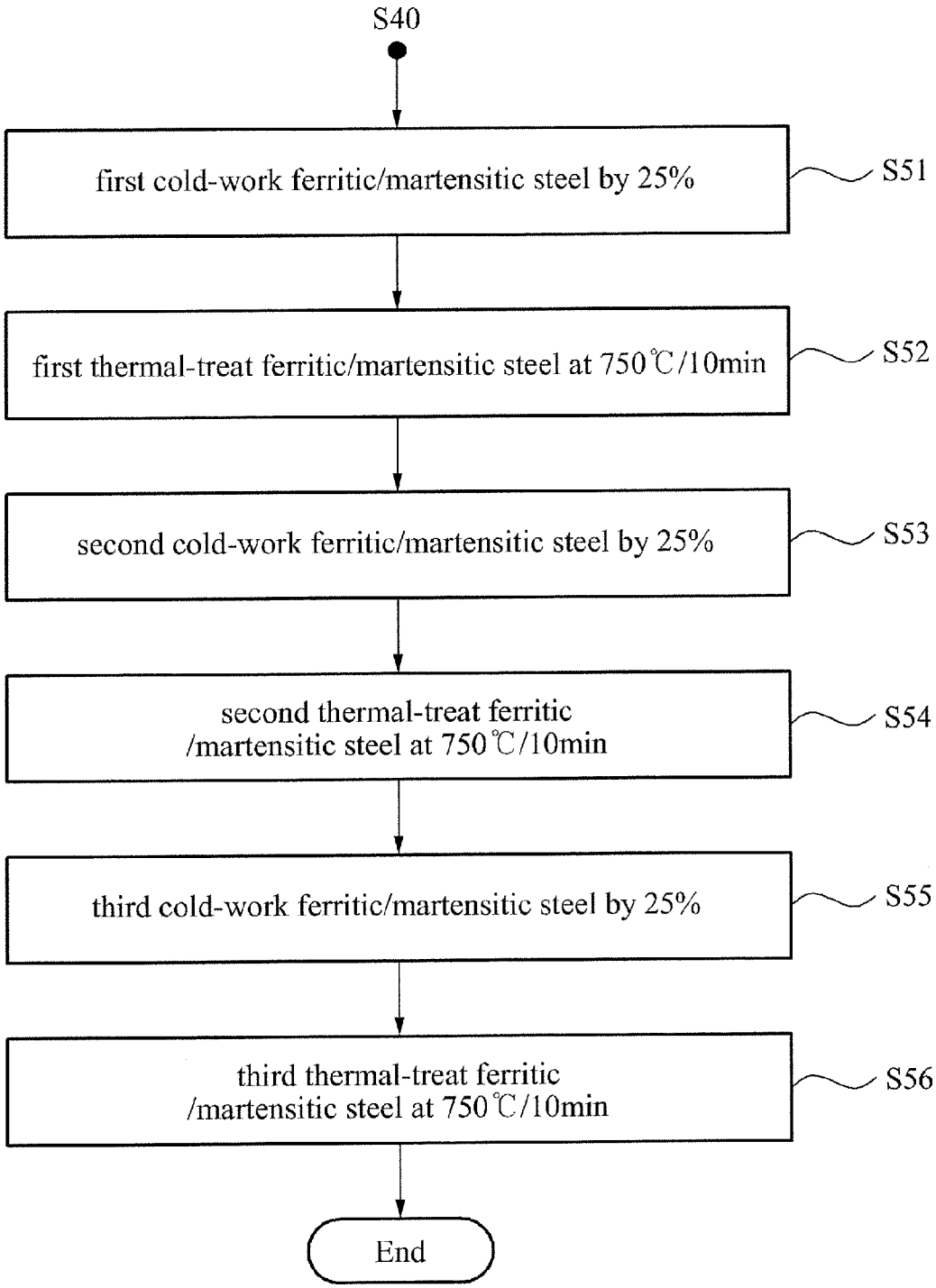
FIG. 2 is a flowchart illustrating cold-working and thermal-treating processes of FIG. 1 performed in a multistage fashion in detail.

FIG. 2 is a flowchart illustrating cold-working and thermal-treating processes of FIG. 1 performed in a multistage fashion in detail.

As illustrated in FIG. 2, in operation S51, the tempered ferritic/martensitic steel may be first cold-rolled in room temperature by a reduction ratio of about 25%. In operation S52, the first cold-rolled ferritic/martensitic steel may be first thermal-treated at a temperature of about 730° C. to 780° C. for about 10 minutes. According to the present exemplary embodiment, at the time of the first thermal-treating S52, the ferritic/martensitic steel may be first thermal-treated at a temperature of about 750° C. for about 10 minutes.

Next, in operation S53, the first thermal-treated ferritic/martensitic steel may be second cold-worked by a reduction ratio of about 25%, and the second cold-worked ferritic/martensitic steel may be second thermal-treated at a temperature of about 750° C. for about 10 minutes. As a result, a cold-working ratio of the ferritic/martensitic steel may approach about 50%. When the second cold-working and thermal-treating S53 and S54 are completed, the second thermal-treated ferritic/martensitic steel may be third cold-worked by about 25% in operation S55, and the third cold-worked ferritic/martensitic steel may be third thermal-treated under a condition of 750° C./10 min in operation S56. As a result, the cold working ratio of the ferritic/martensitic steel may approach about 75%.

When the cold rolling and thermal-treating performed in three stages as described above are completed, the $M_{23}C_6$ precipitate may be precipitated from the ferritic/martensitic steel during the thermal-treating. In this instance, the precipitate precipitated from the ferritic/martensitic steel may be very fine and uniformly distributed, and thereby a yield strength and a tensile strength in a high-temperature environment may be improved by more than 30%.

In addition, according to the present exemplary embodiment, the ferritic/martensitic steel may be cold-worked and thermal-treated in three stages to obtain a cold-rolling ratio of about 75%, however the present invention is not limited thereto. Also, the cold-working ratio may be sufficiently adjusted in each cold-working.

Although a few exemplary embodiments have been shown and described, it would be appreciated by those skilled in the art that changes may be made in these exemplary embodiments without departing from the principles and spirit of the disclosure, the scope of which is defined in the claims and their equivalents.

What is claimed is:

1. A method of manufacturing a ferritic/martensitic steel, the method comprising:

melting a ferritic/martensitic steel having 9-12 wt % chromium;

hot-working the melted ferritic/martensitic steel;

normalizing the hot-worked ferritic/martensitic steel at a temperature of 1050° C. to 1200° C.;

tempering the normalized ferritic/martensitic steel by thermal-treating the normalized ferritic/martensitic steel at a temperature of 600° C. or less for two hours, and leaving MX precipitates while avoiding the formation of $M_{23}C_6$ precipitates; and precipitating $M_{23}C_6$ precipitates by multi-stage cold-working and thermal-treating a cold-worked ferritic/martensitic steel at a temperature of 730° C. to 780° C., wherein the tempered ferritic/martensitic steel is first cold-worked by cold-rolling at room temperature by a reduction ratio of 25%, and the first cold-worked ferritic/martensitic steel is first thermal-treated at a temperature of 730° C. to 780° C. for 10 minutes to obtain a first thermal-treated ferritic/martensitic steel, then the first thermal-treated ferritic/martensitic steel is second cold-worked by cold-rolling by a reduction ratio of 25%, and the second cold-worked ferritic/martensitic steel is second thermal-treated at a temperature of 750° C. for 10 minutes to obtain a second thermal-treated ferritic/martensitic steel, then the second thermal-treated ferritic/martensitic steel is third cold-worked by cold-rolling by a reduction ratio of 25%, and the third cold-worked ferritic/martensitic steel is third thermal-treated under a condition of 750° C. for 10 minutes to manufacture the ferritic/martensitic steel.

* * * * *